United States Patent [19]

Malewski et al.

[11] Patent Number: 4,505,133

[45] Date of Patent: Mar. 19, 1985

[54] ABSORPTION REFRIGERATION SYSTEM WITH BOOSTER COMPRESSOR AND EXTRACTION OF A PARTIAL VAPOR FLOW AT AN INTERMEDIATE PRESSURE

[75] Inventors: Werner Malewski; Günther Holldorff, both of Berlin, Fed. Rep. of Germany

[73] Assignee: Borsig GmbH, Berlin, Fed. Rep. of Germany

[21] Appl. No.: 510,308

[22] Filed: Jul. 1, 1983

[30] Foreign Application Priority Data

Jul. 12, 1982 [DE] Fed. Rep. of Germany ..... 3226377

[51] Int. Cl.[3] ..... F25B 15/00

[52] U.S. Cl. ..... 62/476; 62/483

[58] Field of Search ..... 62/476, 483

[56] References Cited

U.S. PATENT DOCUMENTS

| | | | |
|---|---|---|---|
| 2,548,699 | 4/1951 | Bernat et al. | 62/483 |
| 3,990,264 | 11/1976 | Patnode et al. | 62/476 |
| 4,031,712 | 6/1977 | Costello | 62/483 |
| 4,285,211 | 8/1981 | Clark | 62/476 X |

*Primary Examiner*—Lloyd L. King

*Attorney, Agent, or Firm*—Max Fogiel

[57] ABSTRACT

An absorption refrigeration system with a booster compressor in which at least one partial flow of a refrigerant vapor is extracted at an intermediate pressure appropriate for absorption.

The method is performed by installing at least one additional absorption stage for the absorption of the extracted partial flow. Only the remaining refrigerant vapor has to be compressed to the total pressure difference.

3 Claims, 2 Drawing Figures

ABSORPTION REFRIGERATION SYSTEM WITH BOOSTER COMPRESSOR AND EXTRACTION OF A PARTIAL VAPOR FLOW AT AN INTERMEDIATE PRESSURE

The invention concerns an absorption refrigerating system with a booster compressor which increase the vapor pressure of a refrigerant leaving the evaporator to a level that permits absorption at pre-determined heating-medium parameters (e.g. temperature).

System of this type have been known for a long time and are specified for example in Niebergall, *Handbuch der Kaltetechnik* ("Refrigeration Handbook"), Vol. VII, "Sorptionskältemaschinen ('Sorption-type refrigeration machines')", Berlin, Springer, pages 95 & 96 (1959). It is common practice to equip absorption refrigerating systems with several absorption stages to permit refrigerant vapor to be absorbed at different pressures. This method increases the concentration difference of the refrigerant in the absorption-refrigeration cycle, improving the energy balance of the process and decreasing prime cost.

The higher the absorption pressure in absorption refrigerating systems operating under identical working conditions, the less heating energy input is required. The power input required for compression decreases with the pressure difference that must be overcome and with the mass flow rate to be compressed.

In cases without side loads at various evaporation pressure levels, the only type of booster compressor that could be employed up to now has been one that compresses the total mass flow of refrigerant vapor from evaporation pressure to the absorption pressure of the subsequent single-stage absorption refrigerating system.

The present invention is intended to decrease the energy input demands of the compressor and absorption refrigerating system to the extent that the aforesaid advantages can be combined.

This objective is achieved in accordance with the invention by extracting one or more partial flows of refrigerant vapor at an intermediate pressure appropriate for absorption to be reabsorbed in one or more additional absorption stages. The power input of the booster compressor is accordingly decreased because it will not have to compress the total flow of refrigerant vapor.

Absorption energy balance will also be improved because absorption can be performed in several stages. Furthermore extracting a partial flow an increasing discharge pressure of booster compressor will reduce heat requirements and the prime cost of an absorption refrigerating system at constant power demand of the compressor.

One embodiment of the invention will now be specified by way of example with reference to the drawing.

Figure 1:
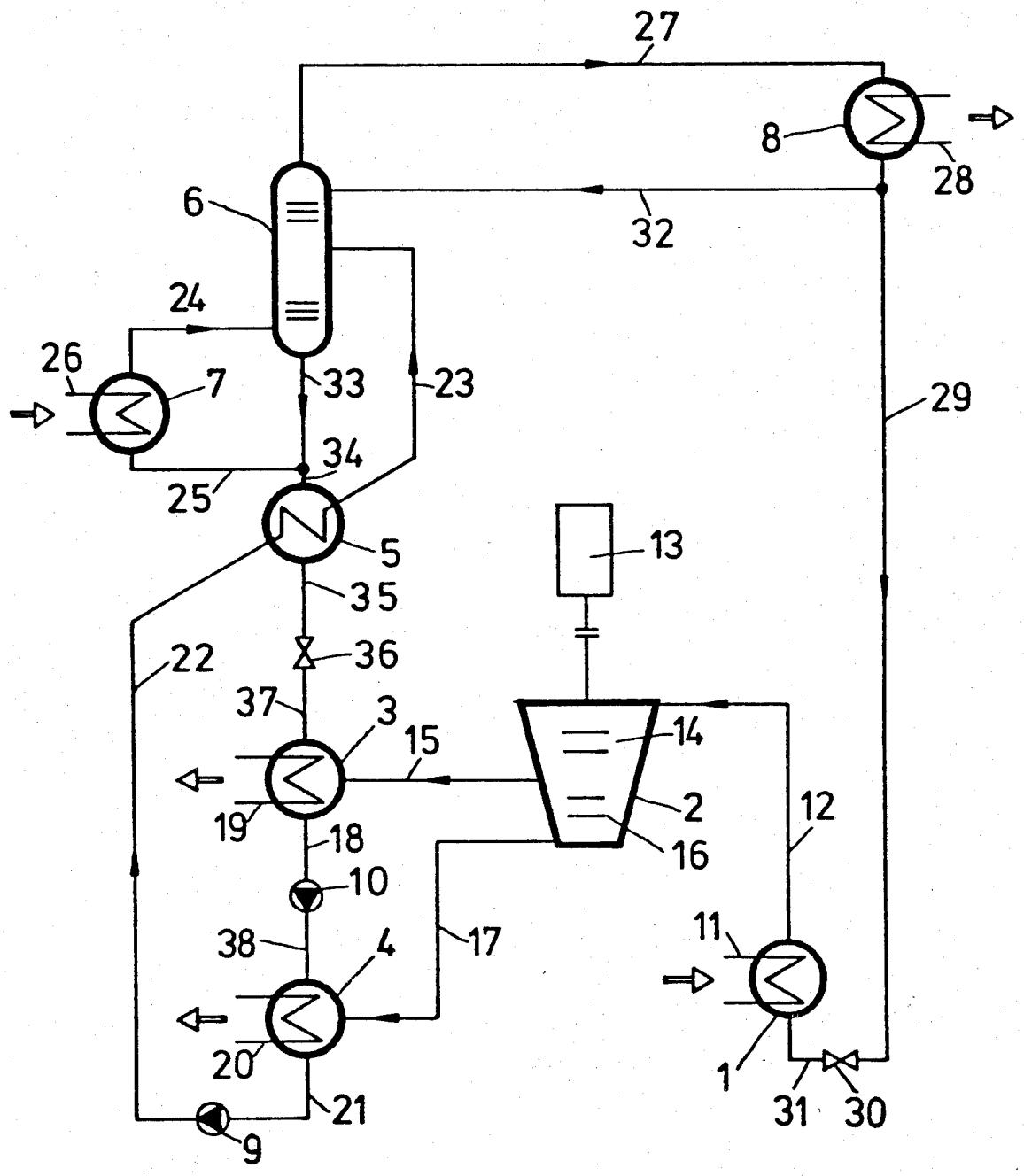
FIG. 1 is a schematic view and shows the essential elements in the method according to the present invention.
Figure 2:
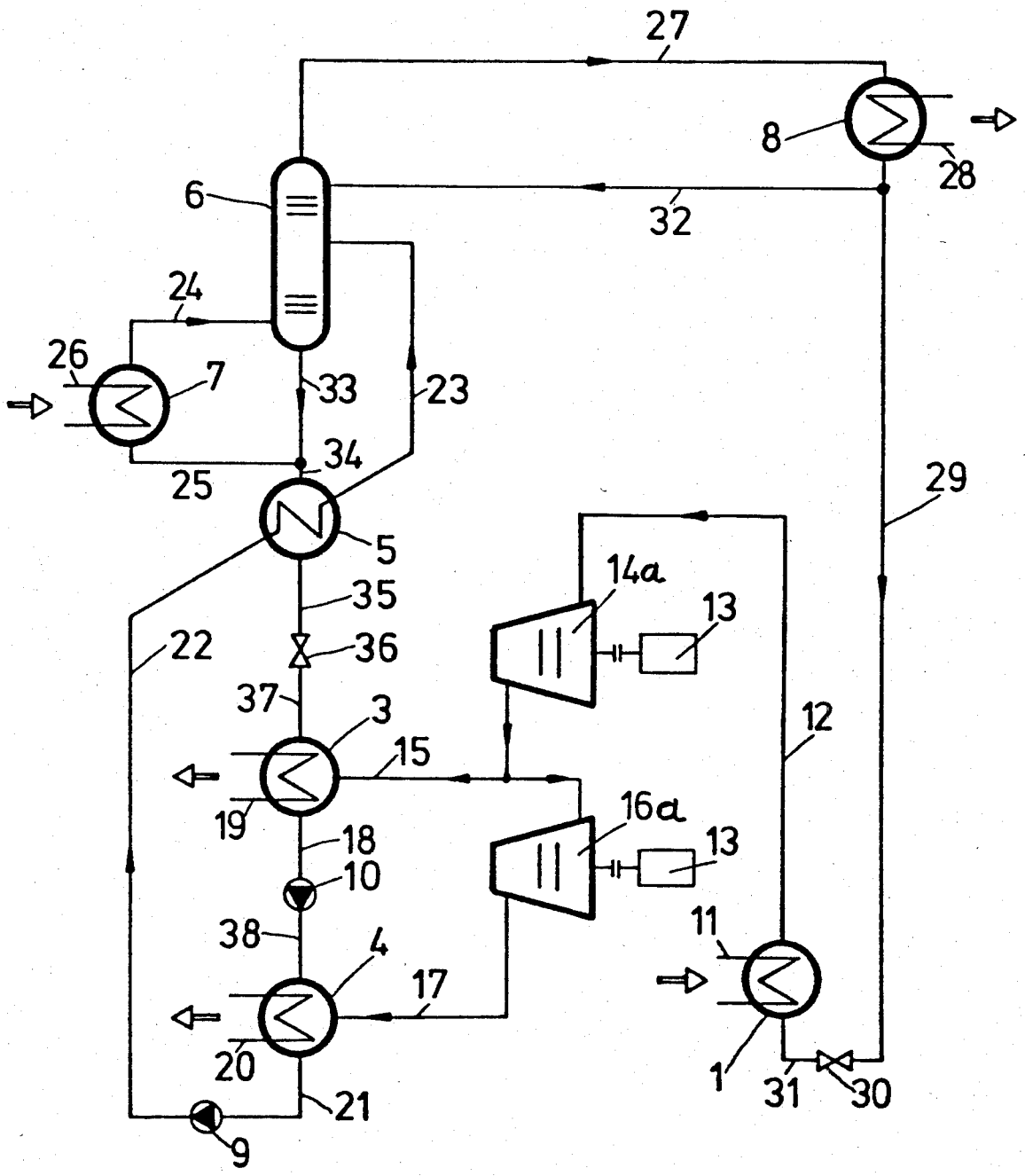
FIG. 2 is a schematic view and shows another embodiment of FIG. 1.

Refrigerant evaporized by heat in an evaporator 1 is suctioned into the booster compressor 2. A partial flow of the refrigerant vapor, compressed to an intermediate pressure, is extracted from the compressor and supplied to an additional absorber 3. The remaining flow of refrigerant is compressed to the pressure of the main absorption stage and absorbed in an absorber 4.

The absorption solution, which has been enriched with the refrigerant vapor, is conveyed by a pump 9, and subject to internal heat exchange in heat exchanger 5, to a desorption section consisting of a desorber 7 and rectifying column 6.

Heat is supplied to desorber 7 to regenerate the solution, and almost pure refrigerant vapor is liquified in the condenser 8, and expanded again in evaporator 1. The solution with reduced refrigerant concentration is, subsequent to heat exchange in heat exchanger 5, expanded to the first absorption stage, where it is partly enriched in absorber 3 and conveyed by a pump 10 to second absorber 4.

In more detail, refrigerant evaporated at evaporation pressure $p_o$, for example, by heat removed from the product 11 to be chilled in evaporator 1, is suctioned via inlet line 12 into the booster compressor 2, driven by means of a suitable driver 13.

The refrigerant vapor is compressed in the first compressor stage 14 (consisting of one or more impellers in case of turbo-compressors) to an intermediate pressure $p_{A1}$, for example, where a partial flow of the refrigerant vapor is extracted via line 15 from the compressor 2 to an additional absorber 3.

The remaining flow of refrigerant vapor is further compressed in the second compressor stage 16 to the pressure $p_{A2}$, for example, of the main absorption stage and conveyed via outlet line 17 to absorber 4.

The absorption solution is enriched in two stages with the refrigerant vapor, first in absorber 3, then in absorber 4 after having been conveyed to this apparatus by means of solution pump first stage 10 via lines 18 and 38.

In both absorbers 3 and 4 the generated absorption heat is rejected to the ambient by means of suitable cooling medium 19 and 20.

After absorber 4, the enriched solution is conveyed to a solution heat exchanger 5 via line 21, solution pump second stage 9 and line 22.

In the heat exchanger 4 the enriched solution is preheated by internal heat exchange with the solution of lower refrigerant concentration and fed via line 23 into the lower part of the rectifying column 6.

This column is connected via lines 24 and 25 with the desorber 7 (sometimes called generator), where heat from a suitable heating medium 26 regenerates the solution.

The generated refrigerant vapor increases its concentration of refrigerant in the rectifying column 6 and enters the condenser 8 via line 27. Here, at a condensation pressure $p_c$, the refrigerant vapor is liquefied by means of a suitable cooling medium 28. The main flow of liquid refrigerant is expanded via line 29 in the expansion valve 30 to evaporation pressure $p_o$ and fed via line 31 to evaporator 1 closing the refrigerant cycle. A partial flow of the liquid refrigerant is fed via line 32 to the top of the column 6 as reflux for the proper operation of this apparatus.

The solution with reduced refrigerant concentration leaves the desorption section with desorber 7 and rectifying column 6 via the line 33 and 34 and enters the solution heat exchanger 5. Having been precooled by subsequent heat exchange with the enriched solution this solution is expanded via line 35 in expansion valve 36 and fed via line 37 to the first absorption stage with absorber 3, closing the solution cycle, also.

Instead of one booster compressor 2 with extraction means, two or more single compressors 14*a* and 16*a* may be used with extraction from a discharge line of the first compressor.

What is claimed is:

1. A method of operating an absorption refrigeration system with booster compressor means, comprising the steps of: extracting from said compressor at least one partial flow of refrigerant vapor at an intermediate pressure level favorable for the absorption process and injecting said partial flow of refrigerant vapor into at least one additional absorption stage; and compressing only the remaining part of refrigerant vapor to the total final pressure difference, whereby energy required for the compressor is reduced and the energy balance of the absorption refrigeration process is improved due to multi-stage absorption; and comprising further, evaporating refrigerant at evaporation pressure by heat removed from a product to be chilled, suctioning the refrigerant into the booster compressor, compressing the refrigerant vapor in a first compressor stage to said intermediate pressure level, said remaining part of refrigerant vapor being further compressed in a second compressor stage and conveyed to an auxiliary absorber, enriching the absorption solution in two stages with refrigerant vapor, rejecting to ambient means generated absorption heat, conveying the enriched solution to a solution heat exchanger, preheating the enriched solution in said heat exchanger by internal heat exchange with a solution of lower refrigerant concentration and feeding into a lower part of a rectifying column, said solution being regenerated by heat in a desorber connected to said column, generated refrigerant vapor increasing its concentration of refrigerant in said column and entering thereafter a condenser, liquefying the refrigerant vapor in said condenser, expanding the liquefied refrigerant in an expansion valve to evaporation pressure and feeding to an evaporator for closing the refrigerant cycle, a partial flow of liquid refrigerant being fed to the top of said column as reflux, solution with reduced refrigerant concentration leaving said desorber and rectifying column and feeding into said heat exchanger and being expanded after precooling and fed to the first absorption stage to thereby also close the cycle.

2. A method according to claim 1, wherein said booster compressor means comprises at least two single compressors with extraction from a discharge line of the first compressors.

3. A method as defined in claim 1, wherein said first compressor stage and said second compressor stage comprise separate compressor units.

* * * * *